US010967212B1

(12) United States Patent
Phillips

(10) Patent No.: US 10,967,212 B1
(45) Date of Patent: Apr. 6, 2021

(54) VERSATILE, HEIGHT-ADJUSTABLE EXERCISE BAR

(71) Applicant: Michael Phillips, LaPlace, LA (US)

(72) Inventor: Michael Phillips, LaPlace, LA (US)

( * ) Notice: Subject to any disclaimer, the term of this patent is extended or adjusted under 35 U.S.C. 154(b) by 0 days.

(21) Appl. No.: 16/407,944

(22) Filed: May 9, 2019

(51) Int. Cl.
*A63B 1/00* (2006.01)
*A63B 23/12* (2006.01)
*A63B 21/00* (2006.01)

(52) U.S. Cl.
CPC ..... *A63B 1/005* (2013.01); *A63B 21/4035* (2015.10); *A63B 23/1218* (2013.01); *A63B 2225/093* (2013.01); *A63B 2225/096* (2013.01)

(58) Field of Classification Search
CPC ..... A63B 1/005; A63B 2225/096; A63B 2225/093; A63B 2225/10; A63B 2225/102; A63B 2225/105; A63B 2225/107; A63B 21/154; A63B 21/155; A63B 21/156; A63B 21/00; A63B 69/406; A63B 2009/004; A63B 2022/0079; A63B 23/00; A63B 23/12; A63B 23/1218; A63B 23/16; A63B 23/1281; A63B 2069/062; A63B 2069/064; A63B 2069/066; A63B 2069/0082; A63B 2069/0086; A63B 2069/0088; A63B 2023/006; A63B 2023/003
USPC ..... 482/38
See application file for complete search history.

(56) References Cited

U.S. PATENT DOCUMENTS 5,299,990 A * 4/1994 Mehlhoff ..... A63B 23/00 482/115
5,725,459 A * 3/1998 Rexach ..... A63B 23/1209 482/92
10,328,307 B2 * 6/2019 Schmidt ..... A63B 21/0058
2004/0192519 A1 * 9/2004 Slawinski ..... A63B 21/078 482/99
2006/0283399 A1 * 12/2006 Bolduc ..... A63K 3/046 119/705
2007/0179030 A1 * 8/2007 Slawinski ..... A63B 21/075 482/98
2012/0202656 A1 * 8/2012 Dorsay ..... A63B 21/00069 482/121
2013/0274075 A1 * 10/2013 Habing ..... A63B 21/078 482/102
2014/0005009 A1 * 1/2014 Giannelli ..... A63B 23/02 482/102
2015/0246258 A1 * 9/2015 Hockridge ..... A63B 21/156 482/99
2018/0021625 A1 * 1/2018 Michaels ..... A63B 21/4034 482/38
2019/0240525 A1 * 8/2019 Leipheimer ..... A63B 21/075

* cited by examiner

*Primary Examiner* — Loan B Jimenez
*Assistant Examiner* — Thao N Do
(74) *Attorney, Agent, or Firm* — Kennethh L Tolar

(57) ABSTRACT

A versatile exercise bar includes a support structure formed of a pair of diverging, horizontal support legs with contiguous rear ends, spaced front ends, and an intermediate portion therebetween. A side rail vertically extends from the intermediate portion of each support leg. Adjustably mounted between the two side rails is an exercise bar that is grasped by a user when performing chin-ups or a myriad of other exercises as explained herein. When moved to a desired height and released, the bar is automatically held by a retention mechanism to allow the user to safely anchor a pair of clamps before performing a given exercise.

7 Claims, 4 Drawing Sheets

VERSATILE, HEIGHT-ADJUSTABLE EXERCISE BAR

CROSS REFERENCE TO RELATED APPLICATIONS

None.

BACKGROUND OF THE INVENTION

The present invention relates to a height-adjustable exercise bar that allows a user to perform a myriad of body-weight exercises on a single apparatus.

DESCRIPTION OF THE PRIOR ART

Chin-ups or pull-ups are an effective means of strengthening the latissimi dorsi, biceps, triceps and other muscles without the need for expensive weight machines or other equipment. A pull-up is also a valuable exercise for those suffering from Kyphosis, or a severe curvature of the spine, which can be improved or even eliminated by strengthening the latissimi dorsi. A conventional chin-up bar often found in gyms, local parks and playgrounds is formed of a pair of vertical. posts with a fixed, horizontal bar extending therebetween. However, for those who cannot initially perform a single pull-up, a conventional chin-up bar is useless.

Due to the difficulty of performing chin-ups, many begin with lat pulls using a weighed lat bar or a similar weight machine to strengthen the pertinent muscles until a chin-up can be performed. However, many weighted lat exercises significantly stress the shoulders and risk injury to the affected joints. In addition, weight stacks or discs on conventional machines are easily dropped, which can cause serious injury or property damage. Finally, because conventional machines employ both weight stacks and complex motion-transfer mechanisms, they are extremely expensive to own and maintain. For the foregoing reasons, strengthening target muscles with body-weight exercises is often preferred to expensive and dangerous weight machines. However, a beginner who cannot perform a chin-up must either use a dangerous weight machine or forego strength training altogether.

In addition to being useless for those who cannot perform a chin-up, conventional chin-up bars are fixed at a height that may be difficult or impossible for some to reach without assistance. Also, the fixed bar is only suitable for pull-ups so that any other strengthening exercises require additional equipment. Although a few vertically adjustable bars exist in the prior art, they are only adjustable within a limited range and in predefined increments. Purchasing and maintaining numerous machines or devices significantly increase an exercise facility's operating costs. Multiple machines also occupy valuable floor space in a home or gym that could otherwise be used for other purposes.

Accordingly, there is currently a need for an exercise device that solves the aforementioned problems associated with conventional chin-up bars and weight machines. The present invention addresses this need by providing an adjustable chin-up bar that allows a novice to immediately begin training target muscles, which is rarely possible with existing exercise equipment. The adjustable bar not only accommodates users of any size but also allows the novice to perform a myriad of modified exercises until a conventional chin-up can be accomplished. For example, the user can lower the bar and angle the body with the feet resting on the ground to reduce the relative amount of body weight that the exerciser is pulling. Therefore, the exerciser can gradually strengthen the pertinent muscles until the chin-up can be performed. The exerciser may similarly apportion the body-weight load when performing pushing exercises to gradually progress to conventional, decline and eventually handstand pushups. Furthermore, the bar can be positioned at a height that allows the user to perform a variety of other exercises that strengthen leg or abdominal muscles without the need for additional costly or dangerous machines. The bar is also fully adjustable in desired increments from floor level to the top of its support frame. Finally, whenever the adjustable bar is moved to a select height, it is automatically held by a retention mechanism until a safety clamp can be secured.

SUMMARY OF THE INVENTION

The present invention relates to a versatile exercise bar including a support structure formed of a pair of diverging, horizontal support legs with contiguous rear ends, spaced front ends, and an intermediate portion therebetween. A side rail vertically extends from the intermediate portion of each support leg. Adjustably mounted between the two side rails is an exercise bar that is grasped by a user when performing chin-ups or a myriad of other exercises as explained herein. When moved to a desired height and released, the bar is automatically held by a retention mechanism to allow the user to safely anchor a pair of clamps before performing a given exercise.

It is therefore an object of the present invention to provide a versatile exercise bar that can be easily adjusted to a desired height.

It is therefore another object of the present invention to provide a height-adjustable exercise bar that automatically remains at a select height when released.

It is yet another object of the present invention to provide a versatile exercise bar that allows a user to easily perform a myriad of body-weight exercises with minimal manipulation of parts or the use of additional machines.

Other objects, features, and advantages of the present invention will become readily apparent from the following detailed description of the preferred embodiment when considered with the attached drawings and the appended claims.

DESCRIPTION OF THE PREFERRED EMBODIMENT

Figure 1:
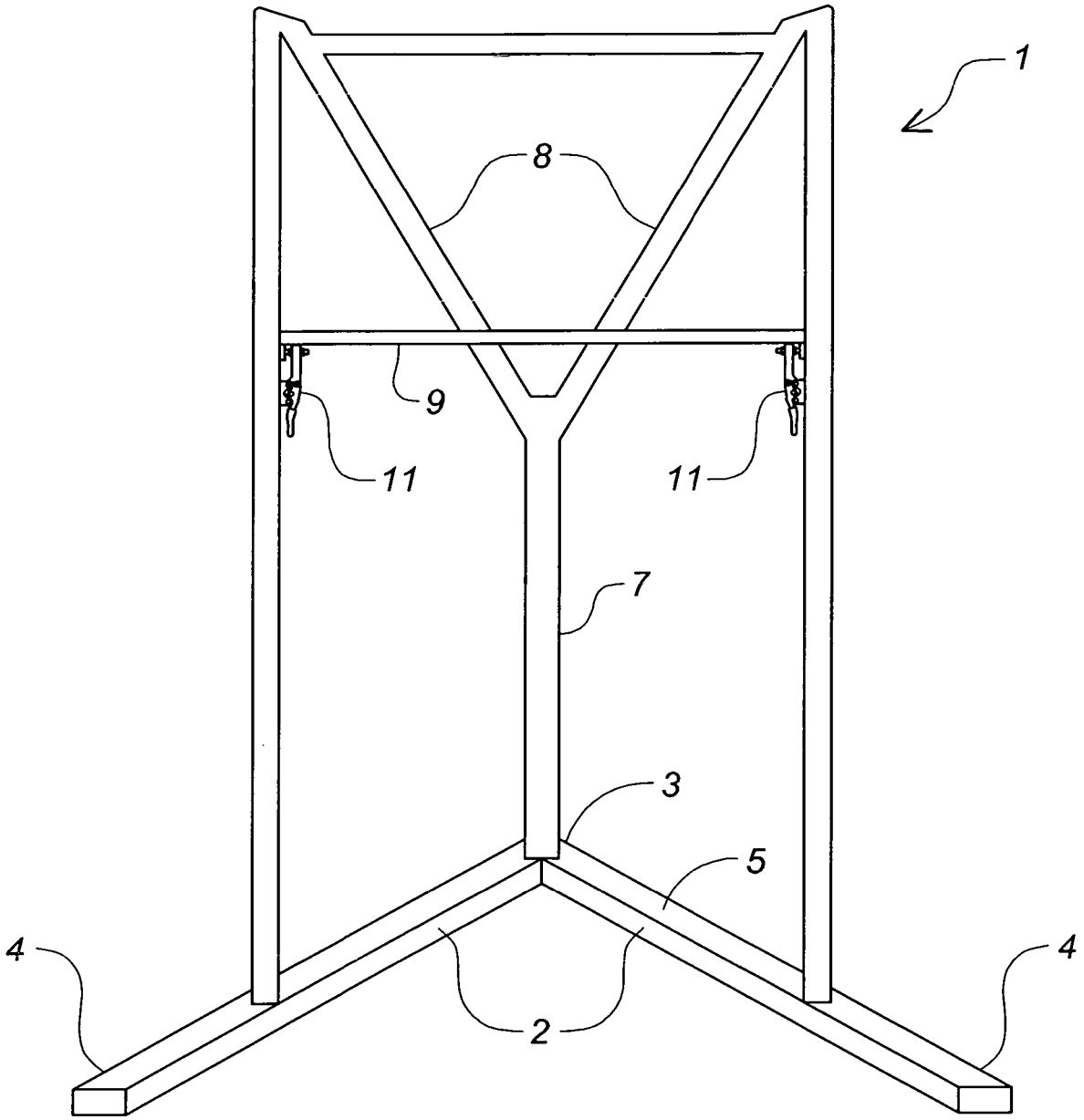
FIG. 1 is a front, plan view of the exercise bar according to the present invention.

Now referring to FIGS. 1-5, the present invention relates to an adjustable exercise bar including a support structure 1 formed of a pair of diverging, horizontal support legs 2 with contiguous rear ends 3, spaced front ends 4, and an intermediate portion 5 therebetween. A side rail 6 vertically extends from the intermediate portion of each support leg.

Uprightly extending from the rear end of each support leg is a beam 7 that is shorter than the side rails. A strut 8 extends from the upper distal end of each beam to the top end of each support rail so that the struts, beams, support legs and side rails define a pair of a pair of diverging, quadrilateral side frames with downwardly sloping top portions. The unique configuration of the support structure facilitates the moving and positioning of the device within confined or irregular spaces in gyms, rooms, or other designated workout areas.

Adjustably mounted between the two side rails is an exercise bar 9 that is grasped by a user when performing chin-ups or a myriad of other exercises as explained below. The bar is longitudinally slidable within channels 10 formed on the inner surfaces of each side rail 6 to allow the bar to be quickly adjusted to a select height. When released, the bar is automatically held at the select height by a retention mechanism that allows the user to safely anchor a pair of clamps 11 before performing a given exercise. Accordingly, the user is not required to hold the bar with one hand while manipulating he clamp as with conventional exercise machines. Moreover, the bar will not inadvertently fall when the clamp is released. Preferably, the side rails each include incremented measurement indicia to allow an exerciser to record and track prior workouts and modify future workouts accordingly.

Figure 2:
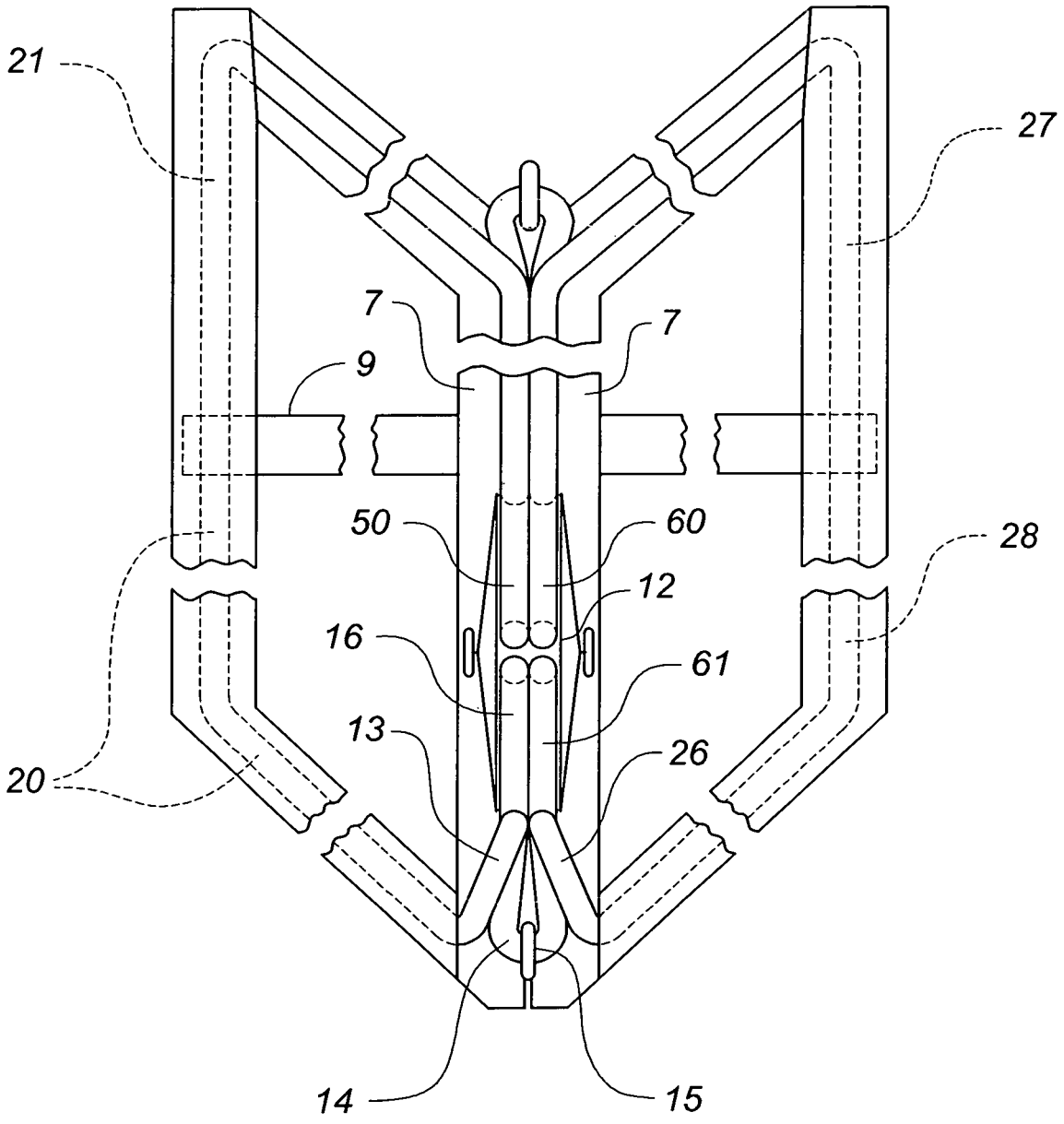
FIG. 2 is a rear, elevated view of the exercise bar
Figure 3:
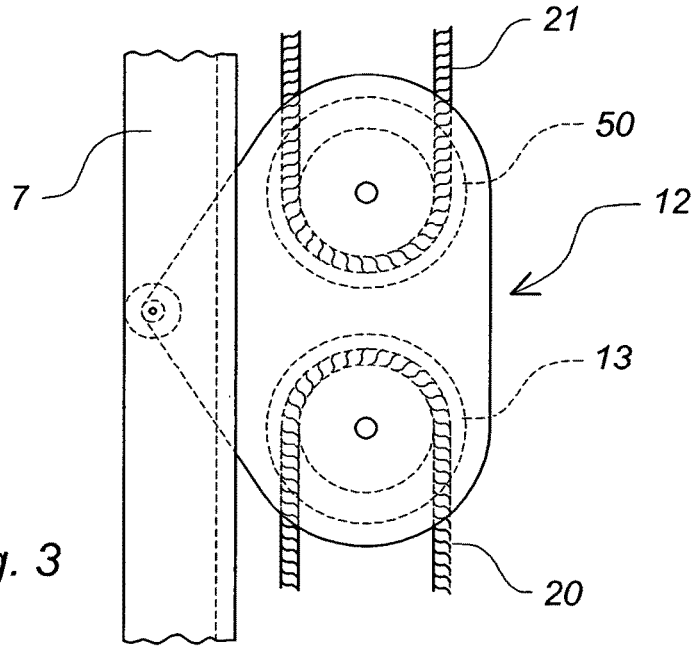
FIG. 3 is an isolated, side view of the tandem pulley.
Figure 4:
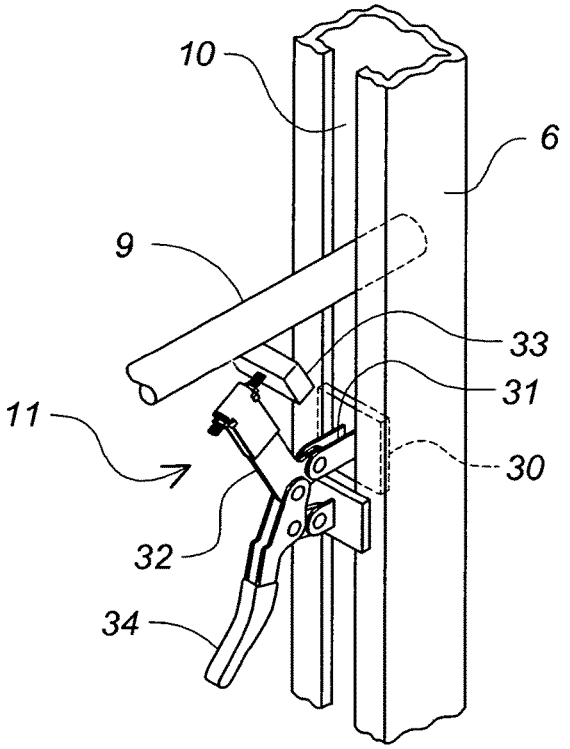
FIG. 4 is an isolated, perspective view of the clamp in a released position.
Figure 5:
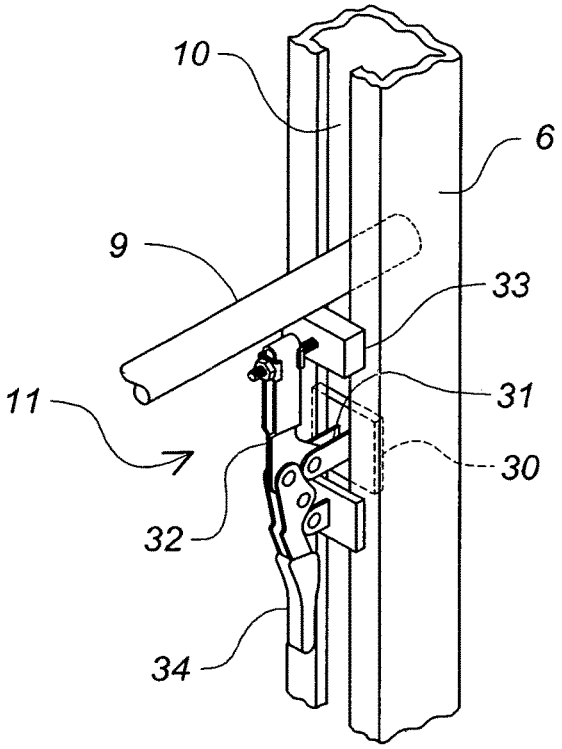
FIG. 5 is an isolated, perspective view of the clamp in a locked position.

Now referring specifically to FIGS. 2 and 3, the retention mechanism includes a tandem pulley 12 that is suspended behind the two beams by one or more cords that traverse the support frame and encircle or grip the exercise bar. A first cord 13 has a first end 14 secured to an eye bolt 15 or similar anchor at or near the lower end of the beams. The first cord 13 includes a lower segment 20 that traverses a path along the first side frame, extending upwardly from the anchor along the beam, around a lower spool 16 of the tandem pulley, downwardly to the lower end of the beam, through the adjoining support leg, upwardly within the attached side rail, and encircling the left or right end of the exercise bar. An upper segment 21 of the cord continues upwardly within the corresponding side rail, rearwardly within the strut, downwardly along the beam, around an upper spool 50 of the tandem pulley and is fastened to a bolt or similar anchor positioned at the upper end of the beams. A second cord 26 includes upper 27 and lower 28 segments that traverse a similar path along the opposing side frame, and encircle upper 60 and lower 61 spools of the tandem pulley and the opposing end of the exercise bar. Each intersection of the beams, support legs, struts and side rails includes an internal elbow that provides a bearing surface to smoothly redirect the cord as it transitions from one component to another.

Accordingly, the counteracting forces applied by the upper and lower cord segments will cause the bar to rest at a select height when released until the bar can be safely anchored to support an exerciser's body weight. However, only a relatively minimal force is required to raise or lower the bar to the desired height. Specifically, the tandem pulley and cord segments form two opposing 2:1 mechanical advantage systems that apply tension to the cords to generate friction within the spools and elbows, which retain the bar in a fixed position when released. Tension applied to the lower cord segments, lower spools and elbows provide continuous friction needed by the upper components to retain he bar in the select position. Because the 2:1 mechanical advantage systems use the same size pulleys and cords, the upper and lower cord segments each yield to or draw from the other as the bar is moved vertically, thereby maintaining a constant tension on the cords and consistent resistance to motion throughout the entire range of adjustability. In addition, because the upper and lower cords travel along parallel paths around the upper and lower pulley spools, the bar also remains level when released. The 2:1 mechanical advantage described herein also assures that the tandem pulley must only travel half the vertical distance of the exercise bar so that the beams(s) can be significantly shorter than the rails. Therefore, the exercise bar can have an effective adjustment range within nearly the entire height of a given room. However, the frame can be fully assembled in a horizontal orientation, with the front rails down, for convenience. When the rear of the frame is lifted to an upright position for use, the beams will not collide with the ceiling.

The clamp 11 is slidably mounted on each side rail to anchor each end of the bar at the select height. The clamp is preferably of the type commonly referred to as a toggle hold-down clamp having a guide plate 30 that rides within the rail channel 10. Attached to the guide plate is a bracket 31 with a locking member 32 pivotally attached thereto. A distal end of the locking member includes a block 33 having a substantially planar upper surface for supporting the exercise bar. A lever 34 drives the locking member and block into fixed engagement with the side rail to safely support the bar and an exerciser's body weight.

Numerous other clamping mechanisms may be used in lieu of the above-described toggle clamps. For example, spring-biased cam lugs can be used to releasably engage the rails to fix the bar at the select height. A button or lever slidable within a slot formed on one or both ends of the exercise bar is operably connected to the cam lugs. When the lever or button is depressed, the lugs disengage to allow the bar to move freely. When the lever or button is released, the lugs engage the rails to fix the bar at the selected height. Preferably, the button is positioned on the bar in an area that would not otherwise be grasped by a user when exercising. The cam-lug variation allows the exerciser to fix the bar without releasing or freeing the hands.

Another alternative includes an electromagnet that thrusts the spring-biased cam lugs against the side rails. Wiring to energize the electromagnets can be integrated within the cords. The electromagnetic clamping mechanism allows a user to fix the bar by simply depressing a switch or button.

The tandem pulley could instead be formed of electromagnetic spools that, when energized, are immobilized to fix the bar at the select height. When the spools are de-energized, the bar is released and can be readjusted as desired. Accordingly, as with the electromagnetic clamping mechanism, the bar can be fixed by simply manipulating a switch or a button.

Finally, the exercise bar can be secured by using a prusik or similar knot to clamp one of the upper cords. However, such a clamping arrangement could expose the cord to excessive wear-and-tear due the increased impact from the user's body weight.

Figure 6:
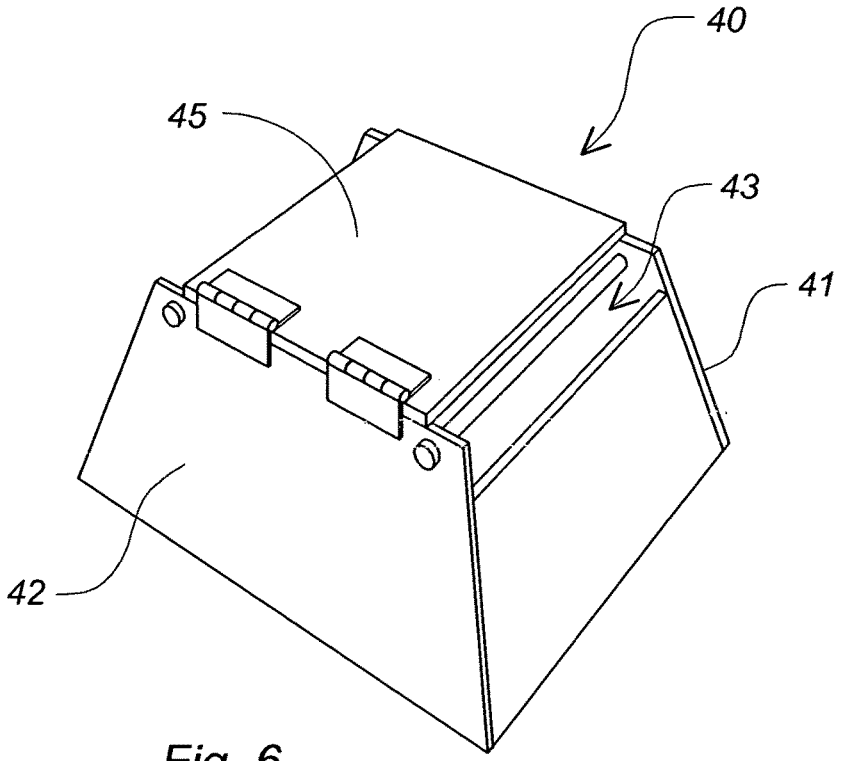
FIG. 6 depicts the accessory stool for use with the versatile, adjustable exercise bar.
Figure 7:
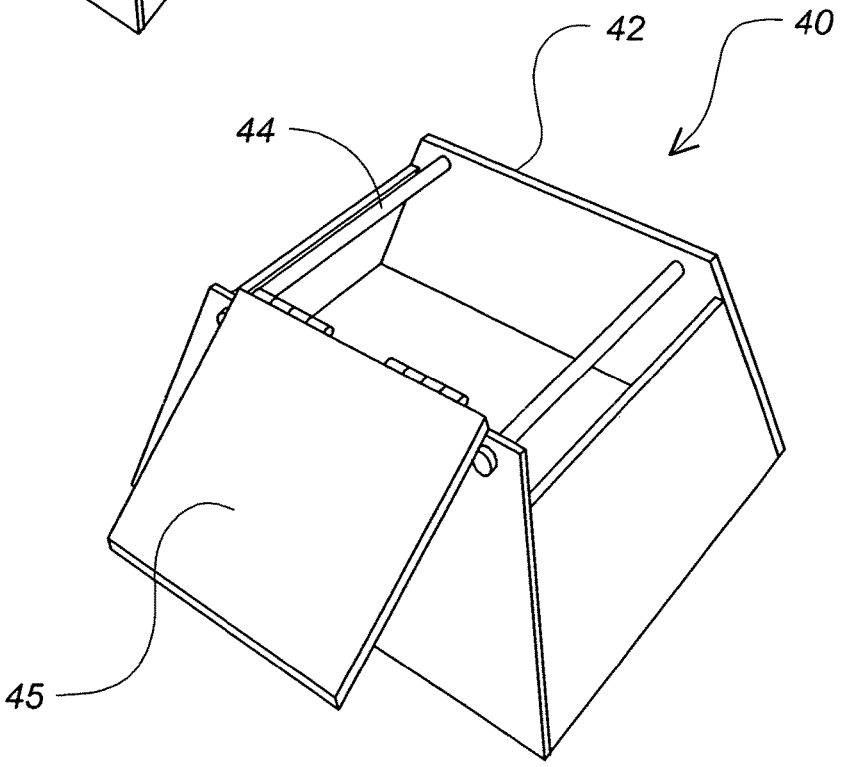
FIG. 7 depicts the stool of FIG. 6 with the cover opened.

Now referring specifically to FIGS. 6 and 7, an accessory stool 40 allows smaller users to access the bar in the event a prior, taller user left the bar at an inaccessible height. The stool includes a hollow housing 41 having a plurality of sidewalls 42 and an open top 43 in communication with an interior chamber. Within the interior chamber are a pair of spaced rods 44 extending from one sidewall to an opposing wall. The rods 44 may be grasped by a user when performing handstand pushups or similar exercises in an inverted position. A hinged cover 45 can be pivoted to rest on upper edges of the two opposing side walls to provide a fixed platform on which the smaller user can stand to access an elevated bar.

As is readily apparent from the detailed description above, the present invention relates to an exercise bar that can be quickly and easily adjusted to a desired position to allow users of any size to easily access the bar when performing pull-ups. Moreover, the movable bar allows a user to perform a myriad of different exercises that strengthen other muscles by using only body-weight resistance. The versatile device also allows a user to easily modify certain exercises if a user is unable to perform the exercise in a conventional manner. For example, the bar can be lowered near ground level to allow the user to execute a modified pull-up by resting the heels on the floor with the body at a predetermined angle to reduce the weight load that the exerciser must pull. The exerciser can further adjust the bar to vary the angle of the exerciser's body to incorporate more or less body weight. Therefore, an exerciser who is unable to perform a single chin-up can perform multiple chin-ups at various angles, gradually lowering the bar until the user can perform the exercise in a horizontal position. Once a predetermined number of chin-ups can be performed in the horizontal position, the exerciser progresses to conventional chin-ups.

The bar can also be positioned at a level that allows a user to perform pushups with the body at a select angle relative to the floor while grasping the bar. As the user gains strength, the bar can be lowered to gradually decrease the angle between the body and floor until the user can perform conventional pushups. As the user further strengthens the pertinent muscles, the bar can be raised to a height that safely supports the user's feet when performing decline pushups. Eventually, the bar can be raised further to support the feet while the user performs handstand pushups. The exerciser can use the stool to grasp the bars when performing handstand pushups, if desired.

The adjustable bar can also be used for stability to allow an exerciser to perform single-leg squats or lunges. The bar can be grasped with both hands to maintain balance while the exerciser extends one leg forward while raising and lowering the body on the other. Likewise, the exerciser can simply hang from the bar and perform various abdominal exercises, such as leg swings, leg lifts or knee tucks.

The above-described device is not limited to the exact details of construction and enumeration of parts provided herein. For example, though the device is described as having a single cord that traverses each side frame, two or more cords can be joined at their ends along the described paths to form the single cord. Moreover, the term "upper cord segment" can be a portion of a single cord or a separate cord joined with a "lower cord segment." Moreover, the term "cord" or "cords" can also mean cables, chains, straps, ropes, wires, or any known or possible similar equivalents that are usable with pulley systems. Furthermore, the size, shape and materials of construction of the various components can be varied without departing from the spirit of the present invention.

Although there has been shown and described the preferred embodiment of the present invention, it will be readily apparent to those skilled in the art that modifications may be made thereto which do not exceed the scope of the appended claims. Therefore, the scope of the invention is only to be limited by the following claims.

What is claimed is:

1. A versatile, adjustable exercise apparatus comprising:

a support structure having two vertical, parallel side rails;

an exercise bar adjustably mounted between and vertically movable along said two vertical, parallel said rails to position said exercise bar at a select height;

means for automatically holding said exercise bar at the select height when said exercise bar is released by an exerciser, wherein said means for automatically holding said exercise bar at the select height when said exercise bar is released by an exerciser includes:

a tandem pulley having at least one upper spool and at least one lower spool;

a first upper cord segment encircling the at least one upper spool and a first end of said exercise bar;

a second upper cord segment encircling the at least one upper spool and a second opposing end of said exercise bar;

a first lower cord segment encircling the at least one lower spool and the first end of said exercise bar;

a second lower cord segment encircling the at least one lower spool and the second opposing end of said exercise bar, whereby the counteracting forces exerted by said first upper cord segment, said second upper cord segment, said first lower cord segment and said second lower cord segment retain said exercise bar at the select height when said exercise bar is released;

means for anchoring said exercise bar at the select height to support the exerciser when hanging therefrom.

2. The versatile, adjustable exercise apparatus according to claim 1 wherein said support structure further comprises:

a pair of diverging, horizontal support legs with contiguous rear ends, spaced front ends, and an intermediate portion therebetween;

each of said two vertical, parallel side rails vertically extending from the intermediate portion of one of said pair of diverging horizontal support legs;

a first beam uprightly extending from the rear end of a first of said pair of diverging, horizontal support legs, a a second beam uprightly extending from the rear end of a second of said pair of diverging, horizontal support legs, said beams shorter than said two vertical parallel side rails.

a strut extending from an upper distal end of each of said beams to a top end of each of said two vertical, parallel side rails to facilitate moving and positioning of said support structure within confined or irregular spaces.

3. The versatile, adjustable exercise apparatus according to claim 1 wherein said means for anchoring said exercise bar at the select height to support the exerciser when hanging therefrom comprises a releasable clamp slidably mounted on each of said two vertical, parallel side rails.

4. The versatile, adjustable exercise apparatus according to claim 3 wherein said releasable clamp comprises:

a guide plate riding within a hollow interior of said two vertical, parallel said rails;

a bracket attached to said guide plate;

a locking member pivotally attached to said bracket;

a block at a distal end of the locking member, said block having a substantially planar upper surface for supporting the exercise bar;

a lever pivotally attached to said locking member that drives said block into fixed engagement with the each of the two vertical, parallel side rail to safely support both the exercise bar and an exerciser's body weight.

5. The versatile, adjustable exercise apparatus according to claim 1 further comprising an accessory stool on which a user stands to access the exercise bar when positioned at an inaccessible height.

6. The versatile, adjustable exercise apparatus according to claim 5 wherein said accessory stool comprises:

a hollow housing having a plurality of sidewalls and an open top in communication with an interior chamber;

a pair of spaced rods received within the interior chamber and extending from one of said plurality of sidewalls to an opposing one of said plurality sidewalls, said rods grasped by a user when performing exercises in an inverted position.

7. The versatile, adjustable exercise apparatus according to claim 6 wherein said accessory stool further comprises a hinged cover pivotal to a closed position, resting on upper edges of said plurality of sidewalls to provide a fixed platform on which the user can stand when accessing the exercise bar.

* * * * *